US005485169A

United States Patent [19]

Kitabatake et al.

[11] Patent Number: 5,485,169

[45] Date of Patent: Jan. 16, 1996

[54] ANTENNA ORIENTING APPARATUS FOR VEHICLES

[75] Inventors: Asao Kitabatake, Kakogawa; Naozumi Tamaoka, Kobe; Hitoshi Ueda, Ashiya; Kenichi Wada, Itami, all of Japan

[73] Assignee: Furuno Electric Company, Limited, Hyogo, Japan

[21] Appl. No.: 98,345

[22] PCT Filed: Dec. 18, 1992

[86] PCT No.: PCT/JP92/01650

§ 371 Date: Aug. 3, 1993

§ 102(e) Date: Aug. 3, 1993

[87] PCT Pub. No.: WO93/12558

PCT Pub. Date: Jun. 24, 1993

[30] Foreign Application Priority Data

Dec. 19, 1991 [JP] Japan ..... 3-336973

[51] Int. Cl.[6] ..... H01Q 1/18; H01Q 3/08

[52] U.S. Cl. ..... 343/765; 343/763; 343/766; 343/709

[58] Field of Search ..... 343/709, 711, 343/765, 766, 882, 763, 757; H01Q 1/18, 1/34, 3/08

[56] References Cited

U.S. PATENT DOCUMENTS

| | | | |
|---|---|---|---|
| 4,209,789 | 6/1980 | Snedkerud | 343/765 |
| 4,392,137 | 7/1983 | Intlekofer et al. | 343/766 |
| 4,543,549 | 9/1985 | Meltzer et al. | 343/763 |
| 4,596,989 | 6/1986 | Smith et al. | 343/765 |
| 4,621,266 | 11/1986 | Le Gall et al. | 342/359 |
| 4,647,939 | 3/1987 | Kolhoff | 343/766 |

FOREIGN PATENT DOCUMENTS

| | | |
|---|---|---|
| 51-14364 | 5/1976 | Japan . |
| 53-16083 | 4/1978 | Japan . |
| 55-7798 | 2/1980 | Japan . |

*Primary Examiner*—Michael C. Wimer
*Attorney, Agent, or Firm*—Jordan and Hamburg

[57] ABSTRACT

A passive, active or mixed platform type antenna orienting apparatus mounts on a vehicle such as a small-sized vessel or an automobile, which is subject to turns and complex vibrations, traces a target such as a communications satellite with a directive antenna. Between a rotational shaft connected to a platform supporting an antenna and a stationery shaft connected to base to be carried on a vehicle, there is interposed as electric rotary coupling for transmitting power and signals necessary for a transmission signal and an attitude control, so that the platform 43 supporting the antenna 1 may continuously rotate with respect to the vehicle 27. Midway of a post 41, moreover, there is disposed a horizontal damping mechanism 70 which includes a laminate 75 and facial pressure apply means 76 for applying a facial pressure to a laminate 75, to effect a damping action which is excellent in durability and even in the horizontal direction.

15 Claims, 5 Drawing Sheets

ANTENNA ORIENTING APPARATUS FOR VEHICLES

BACKGROUND OF THE INVENTION

The present invention relates to a passive, active or mixed platform type antenna orienting apparatus carried on a vehicle, such as a small-sized vessel or an automobile, which turns frequently and experiences complex vibrations, for tracing a target such as a communications satellite with a directive antenna. And more particularly, to an antenna orienting apparatus for a vehicle, which is freed from entanglements of a cable leading to the antenna due to circular travel of the vehicle, and which can provide isolation of the antenna from vehicular vibrations and using a light weight antenna and dampening system.

The orientation of a communications satellite or target is uniquely decided if its azimuth or elevation angle is determined. The azimuth is an angle which measures the orientation of the satellite clockwise from the north in a horizontal plane, and the elevation is an angle which is made between the satellite, the antenna, and the horizontal plane.

Moreover, these angles are functions of the present position of the vehicle, i.e., the longitude and the latitude. Thus, the vehicle is required to trace the satellite by computing the azimuth and elevation on the basis of the data of its present location. The apparatus carried on a vehicle for orienting the satellite communications antenna is ordinarily equipped with a tracing mechanism including a CPU and a servo mechanism. However, the antenna orienting apparatus must maintain an orientation directed to the communications satellite while the vehicle turns to provide satisfactory communication.

A north-directing gyro for computing the present location is provided along with a vertical gyro for giving a vertical reference. The orientation of the antenna can be maintained toward the communications satellite, if the vertical gyro is used to detect the turns or motions (e.g., a rolling or pitching angle in case of a vessel) of the vehicle and its signal drives the aforementioned servo mechanism. This method is of the active platform type, in which the antenna is stabilized together with its orientation control. In this active platform type antenna orienting apparatus, the motions of the antenna are compensated for those of the vehicle, so that the vehicle does not deteriorate the directivity when severe, as in a small-sized vessel.

In contrast to the active platform type, there is known a passive platform type antenna orienting apparatus for stabilizing the antenna by means of a gyro mechanism. This will be described with reference to FIG. 4. An antenna 1 is supported in a rocking manner by an elevation shaft 3 through an elevation panel 2. This elevation shaft 3 is borne in a stable platform 4, which is turnably supported by a shaft 9*a*. To this shaft 9*a*, there are attached through a turnable swivel cylinder 5 two flywheels 6 and 7 which have momentums in a vertical swivel axis.

The shaft 9*a* is connected through a universal joint 8 to a shaft 9*b*. This shaft 9*b* has its lower portions fitted in sliding holes 11 and 12 of a post 10. A bias spring 15 is mounted between a flange 3 of the shaft 9 and a partition 14 of the post 10. A shock absorbing action against the vertical or axial vibration is established by the friction between the sliding holes 11 and 12 and the shaft 9 and by the elastic force of the bias spring 15. The post 10 is supported through a spherical bearing 7 disposed at the center of a base 16, and bias springs 20, having a sliding case, are mounted between four arms 18 extending from the lower end of the post 10 and the folded extensions 19. A shock absorbing action against the horizontal vibration is established by the friction of the sliding case attached to the bias springs 20 and by the elastic force of the bias springs 20. Coupling the stable platform 4 and the shaft 9*a*, moreover there are gears 21 and an azimuth electric motor 22 to orient the antenna 1 to a predetermined azimuth angle. Between the stable platform 4 and the elevation shaft 3, there are disposed gears 23 and an elevation shaft electric motor 24, orient the antenna 1 to a predetermined elevation angle. Additionally: numeral 25 designates a controller attached to the stable platform 4; numeral 26 designates a power supply/control unit; and numeral 27 designates a vehicle such as a fishing boat or the like.

If the vehicle 27 makes either an abrupt turn, changing its direction or a rocking motion such as a rolling or pitching motion, the stable platform 4 of the antenna orienting apparatus thus constructed is always enabled to hold its position, for example, in a horizontal attitude by the bending structure of the universal joint 8 and by the inertial forces of the flywheels 6 and 7. The orientation control of the antenna 1 is carried out by the azimuth shaft motor 22 and the elevation shaft motor 24, as described above.

FIG. 5 is a control block schematic of the antenna orienting apparatus of FIG. 4. The rotary side includes the devices above the stable platform 4 of FIG. 4, and the stationary side includes the devices below the shaft 9*a* of FIG. 4. A power source/control unit 26, is connected through bendable cables 29*a* to 29*e* to a stable platform mechanism 28 for driving the flywheels, a power supply 29 for individual portions, a high power amplifier 25*a* for the controller 25, the elevation shaft motor 24, a position sensor 24*a* for the motor 24, the azimuth shaft motor 22, and a position sensor 22*a* for the motor 22. The controller 25 has its send signal TX/IF, receive signal RX/IF and local oscillator reference signal REF connected through bendable cables 30*a* to 30*c* with a coaxial cable 31.

A first defect of the antenna orienting apparatus thus constructed according to the prior art is that the rotary side and the stationary side are connected through the cables. If the vehicle continuously turns in one direction the cables 29*a* to 20*e* and 30*a* to 30*c* coil around the shafts 9*a* and 9*b* of FIG. 4 either to make it impossible to control the attitude or to disconnect the cables. Thus, a rotary limiter is provided to rewind the stable platform 4 when this platform 4 rotates to its limit, thereby to prevent the coiling of the cables. In order to effect the rewinding, the communications have to be interrupted. A second defect of the antenna orienting apparatus of the prior art resides in the construction that the horizontal vibration is damped by the bias springs 20 at the leading ends of the four arms 18. Especially in a small-sized vessel such as a fishing boat, the horizontal vibration is stronger than the vertical or axial vibration. The bending moment exerted by the bias springs upon the arms 18 tends to break these arms 18. Because of as few as four arms 18, moreover, the damping action is not uniform in the horizontal direction.

It is, therefore, an object of the present invention to provide an antenna orienting apparatus for a vehicle, which is freed from any coiling of cables so that the antenna can rotate many times without interruption of communications. Another object of the present invention is to provide an antenna orienting apparatus for a vehicle, which can dampen the horizontal vibration efficiently and make the weight of the portion to be damped, as light as possible.

SUMMARY OF THE INVENTION

According to the present invention, between a rotational shaft 46, connected to a platform 43 supporting an antenna 1, and an irrotational shaft 44 connected to base 40 to be carried on a vehicle 27, there is interposed an electric rotary coupling 59 for transmitting power supplies and signals necessary for a transmission signal and an attitude control, so that the platform 43 supporting the antenna 1 may continuously rotate with respect to the vehicle 27.

A post 41 includes at a midpoint a horizontal damping mechanism 70 which includes a laminate 75 and facial pressure application means 76 for applying a facial pressure to the laminate 75, to effect a damping action which is excellent in durability, even in the horizontal direction. At the side of the base 40 an electric rotary coupling 59 and rotation means 54 are disposed for determining the azimuth of the antenna 1, thus reducing the size of the antenna side and the load to be borne on the horizontal damping mechanism 70.

DETAILED DESCRIPTION OF THE PRESENT INVENTIONS

Figure 1:
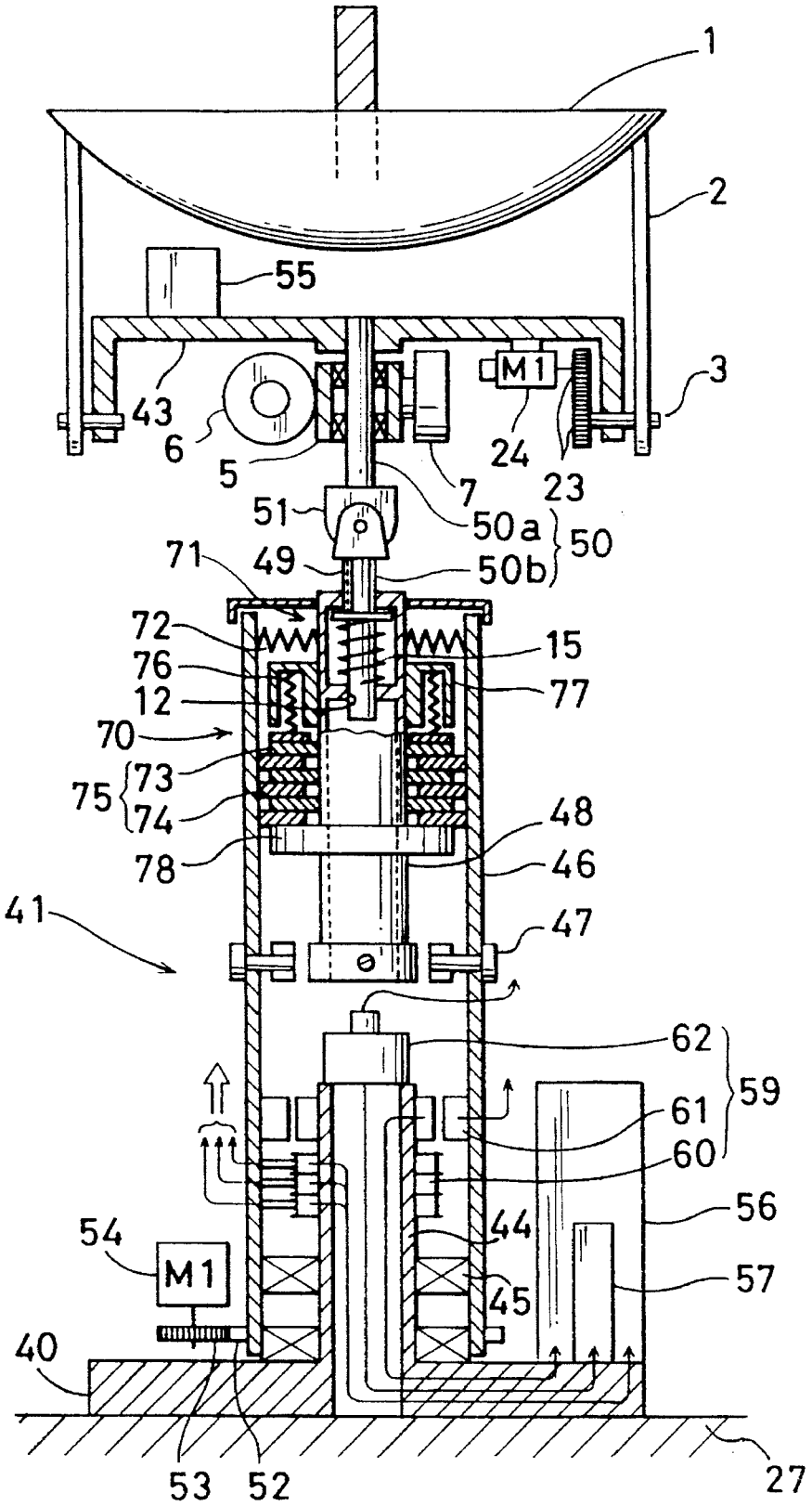
FIG. 1 is a section showing a preferable antenna orienting apparatus according to the present invention.
Figure 4:
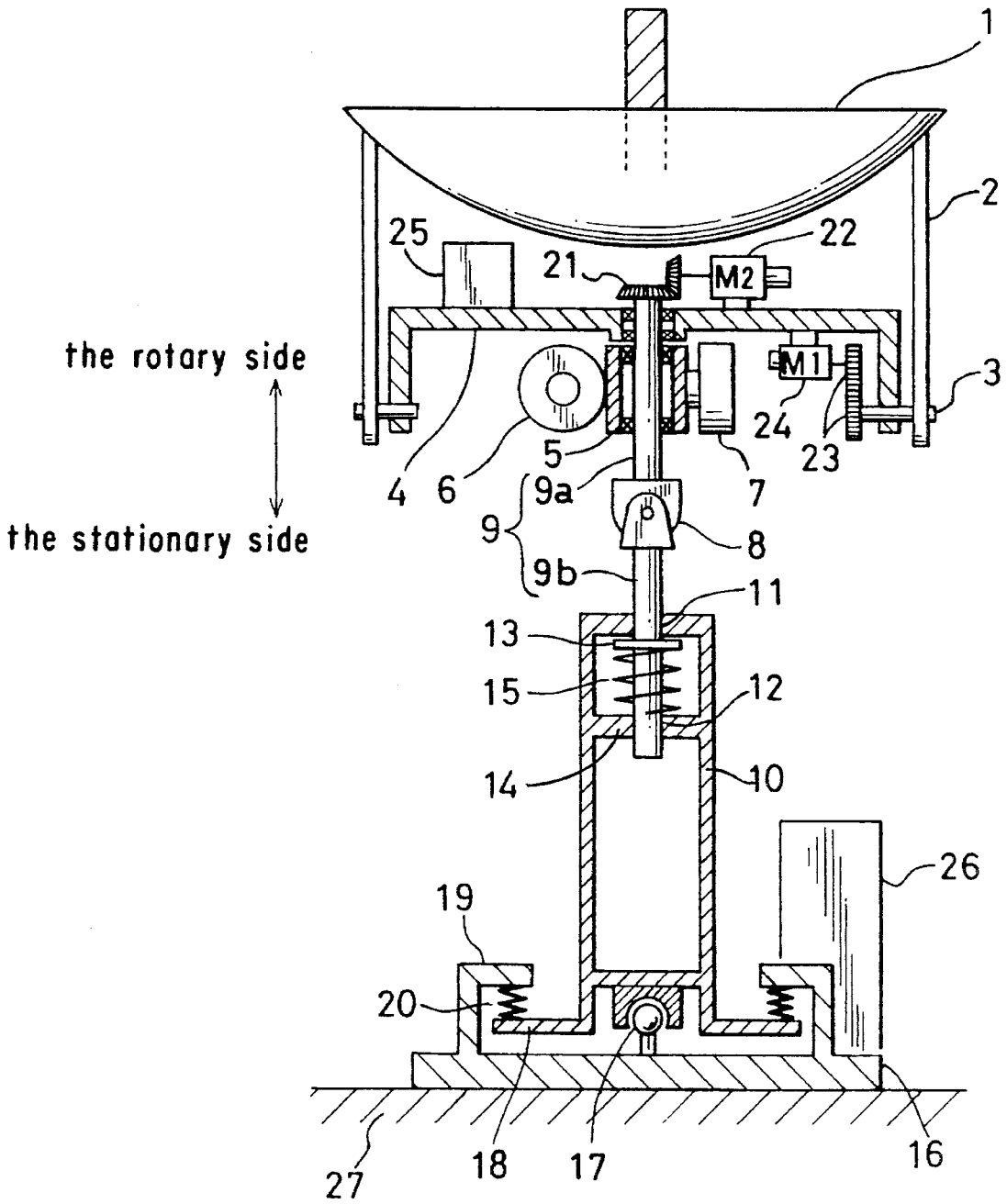
Fig. 4 PRIOR ART
FIG. 4 is a section showing the antenna orienting apparatus according to the prior art.
Figure 5:
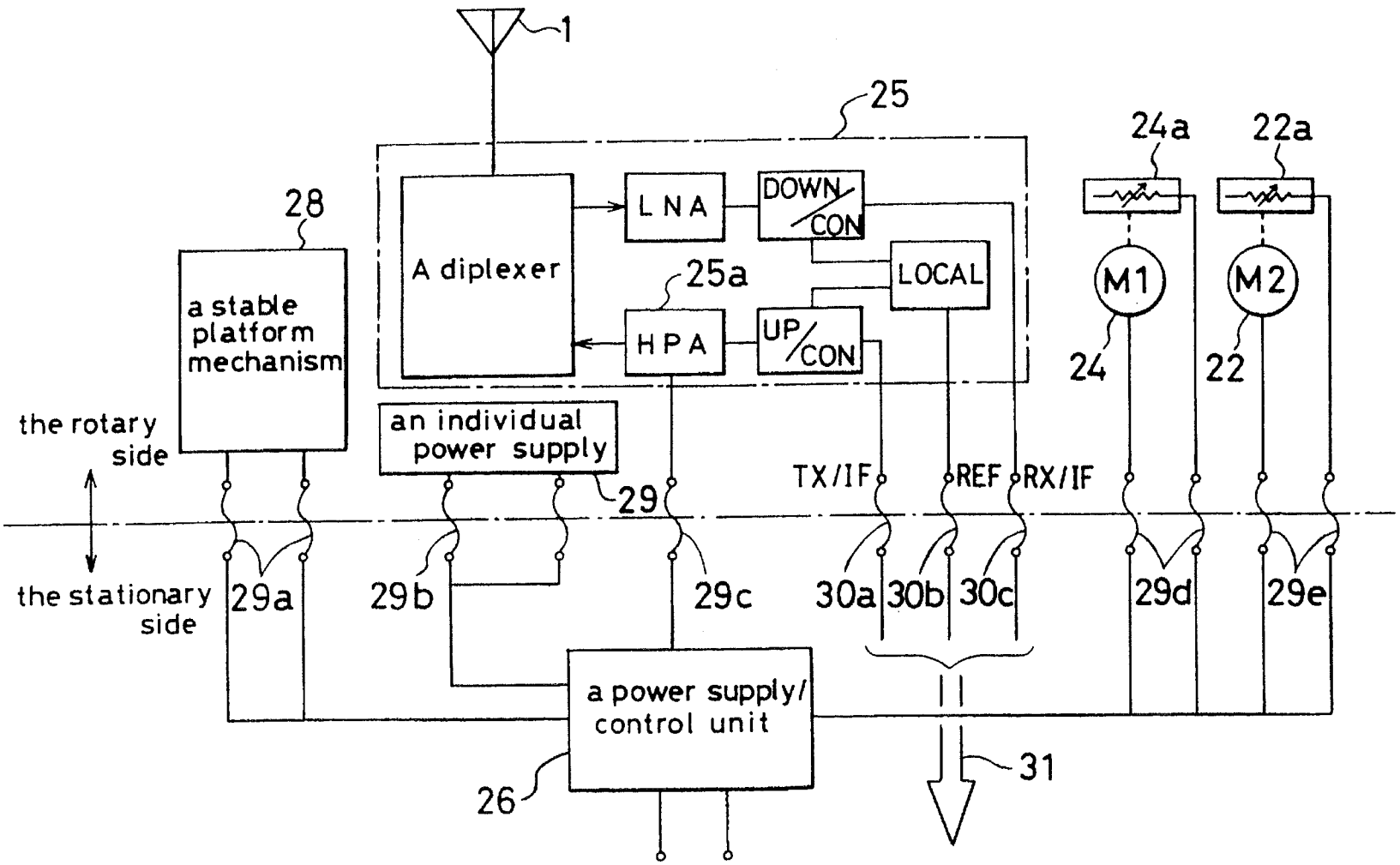
FIG. 5 is a block diagram of the antenna orienting apparatus of FIG. 4.

The present invention will be described in more detail in the following with reference to the accompanying drawings. FIG. 1 is a section showing a preferable antenna orienting apparatus in which an electric rotary coupling 59, replaces cables and a damping mechanism 70 for dampening horizontal shock are fitted in a hollow shaft 46. The difference from the example of the prior art shown in FIG. 4 resides in the provision of electric rotary coupling 59, the change in the type of the horizontal damping mechanism and the disposition of an azimuth shaft motor 54 at the base side. The remaining portions, having the same actions as those of FIG. 4, will be omitted from the detailed description by designating them by common reference numerals, the changed points being detailed in the following.

This antenna orienting apparatus is constructed such that a post portion 41 is erected on the base 40 and such that a stable platform 43, supporting the antenna 1, is supported by the post portion 41. Moreover, this post portion 41 is constructed to include a hollow shaft (i.e., a first shaft) 46 supported rotatably by a bearing 45 by a center shaft 44 of the base 40. The shaft 48 (i.e., a second shaft) is supported through a universal joint (i.e., a universal coupling) 47 inside the hollow shaft 46. A shaft **50*b* (i.e., a third shaft) is fitted slidably through a rotation stopper 49 in the shaft 48, and a shaft 50*a* (i.e., a fourth shaft) connected through a universal joint (i.e., a universal coupling) 51**.

The shaft **50*a* has its leading end fitted and fixed in the stable platform 43. The hollow shaft 46 is rotated through gears 52 and 53 by an azimuth shaft electric motor 54, to set the azimuth (angle) of the stable platform 43 through the universal joint 47, the shaft 48 and the shaft 50. The elevation (angle) of the antenna 1 is set as in the prior art by the elevation shaft electric motor 24 through the gears 23. Moreover, the swivel cylinder 5 bearing the flywheels 6 and 7 is borne as in the prior art to swivel on the shaft 50*a*. Here: reference numeral 55 designates a first controller mounted on the stable platform 43; numeral 56 designates a power source/control unit mounted on the base 40; and numeral 57 designates a second controller mounted on the base 40**.

Moreover, between the center shaft 44, connected fixedly as a stationary shaft with respect to the base 40 and the hollow shaft 46, connected to and rotating with the antenna 1, there is interposed the electric rotary coupling 59 including a slip ring mechanism 60, a rotary transformer 61 and a rotary joint 62. The slip ring mechanism 60 is a contact type rotary coupling, composed of a conductive ring and a conductive brush in combination, supplied with a power supply. The rotary transformer 61 is a non-contact type rotary coupling, arranged with two sets of opposed ring coils, one of which has its magnetic field changed to induce an electric current in the other ring, and which is fed with a control signal. The rotary joint 62 is a non-contact type rotary coupling, which is coaxially arranged with a pair of waveguides at a predetermined gap, and which is fed with a high-frequency transmission signal.

Figure 2:
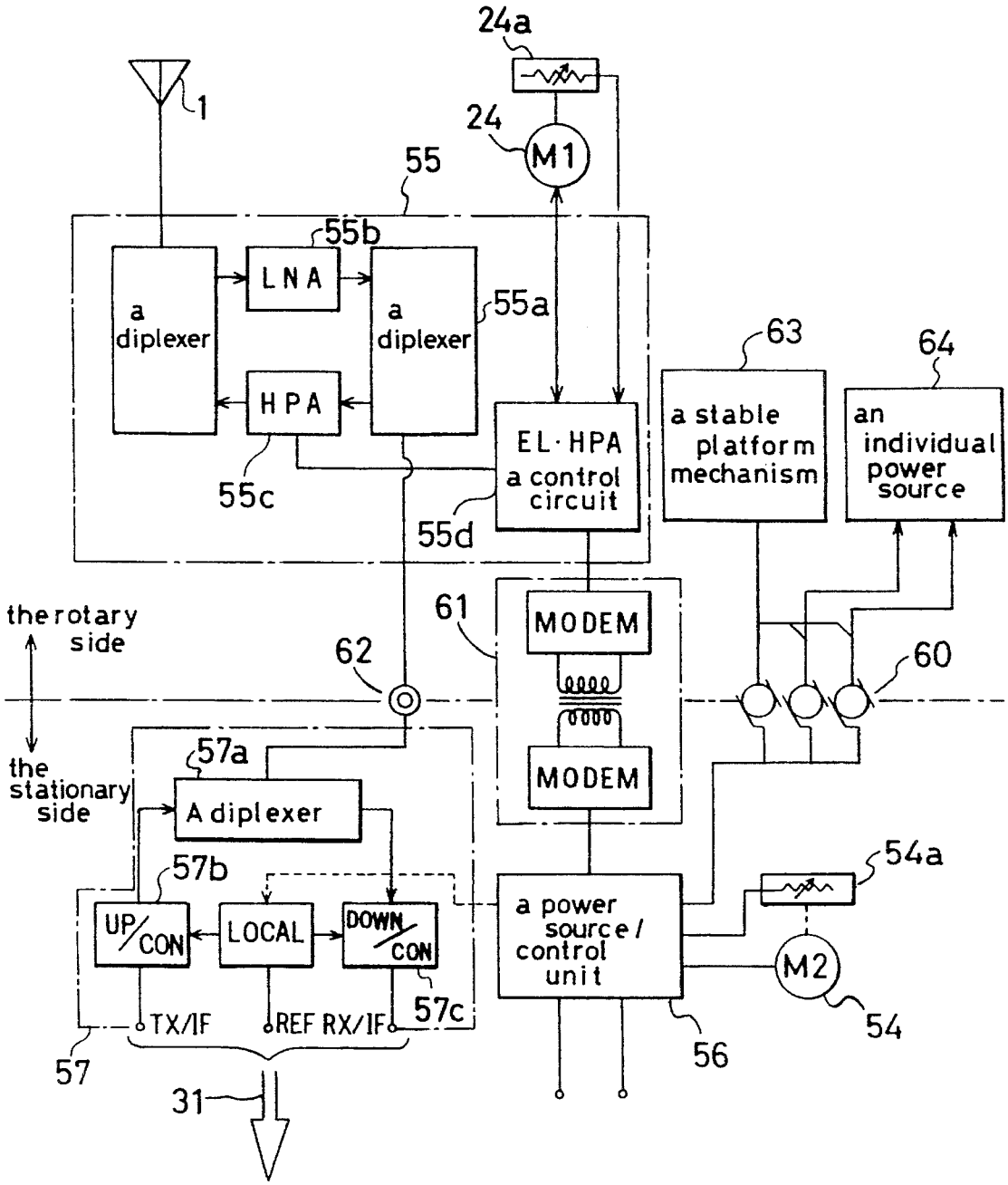
FIG. 2 is a diagram showing control blocks of the antenna orienting apparatus of FIG. 1.

FIG. 2 is a block diagram showing an antenna orienting apparatus using the electric rotary joint described above. A diplexer **55*a*, in the first controller 55 at the rotary side, switches a receive signal from a low-noise amplifier 55*b* (i.e., a receive amplifier at the rotary side) and a send signal to a high-power amplifier 55*c*. This diplexer 55*a* switches one rotary joint 62 for sending and receiving operations. For these switching operations, the second controller 57, at the stationary side, drives its diplexer 57*a* to switch a send signal from a sending converter 57*b* and a receive signal to a receiving converter (i.e., receive means at the stationary side). The signals of the elevation motor 24 and its positioner 24*a* are subjected to an AC transformation by a control circuit 55*d* of the first controller 55 and are connected through the rotary transformer 61 with the power source/control unit 56. The azimuth electric motor 54 and its positioner 54*a* are connected directly with the power source/control unit 56 because they are disposed at the stationary side. A stable platform mechanism 63 and an individual power source 64 are connected through the slip ring mechanism 60 do the power source/control unit 56. Thus, the rotary side and the stationary side are connected through the electric rotary coupling 59 composed of the slip ring mechanism 60, the rotary transformer 61 and the rotary joint 62**, so that the rotary side can rotate unlimitedly.

Reverting to FIG. 1, a damping mechanism 70 for the horizontal vibration is interposed between the hollow shaft 46 and the shaft 48, and an axial damping mechanism 71 for the vertical or axial vibration is interposed between the shaft 48 and the shaft **50*b*. The axial damping mechanism 71 uses the sliding hole 12 and the bias spring 15 as in FIG. 4. The horizontal damping mechanism 70 includes radially arranged bias springs 72 for biasing the axis of the shaft 48 toward the axis of the hollow shaft 46 to restore alignment. A laminate 75, composed of friction plates 74 of aluminum and friction plates 73 of a resin, has bias springs 76 for applying a facial pressure to the laminate 75. The aluminum friction plates 74 are formed into a ring shape fitted within the inner circumference of the hollow shaft 46 while leaving a little space around the outer circumference of the shaft 48. The resin friction plates 73 are formed into a ring shape fitted on the outer circumference of the shaft 48 while leaving a little space in the inner circumference of the hollow shaft 46. Moreover, the bias springs 76 are fitted in a spring holder 77 to bias the laminate 75 toward a flange 78 of the shaft 48 to apply a desired facial pressure upon the aluminum friction plates 74 and the resin friction plates 73 of the laminate 75. If the shaft 48 is vibrated on the universal joint 47 by the horizontal vibration, a displacement is established between the aluminum friction plates 74 and the resin friction plates 73 of the laminate 75 so that a frictional resistance, dependent on the strength of the bias springs 76 and the frictional coefficients between the friction plates 73 and 74, is established to attenuate the vibration. A restoration force proportional the displacement is established by the radially arranged bias springs 72** so that an original attitude is restored when the vibration is settled.

This horizontal damping mechanism 70 is constructed of the combination of the radially arranged bias springs 72, which are interposed between the hollow shaft 46 and the shaft 48, and the friction plates 73 and 74 which are given the facial pressure by the bias springs 76. Thus, the horizontal damping mechanism 70 is durable, compact, and effects an even damping action around the whole circumference in the horizontal direction. The facial friction can be adjusted by changing the number of the friction plates 73 and 74 composing the laminate, the material of the resin friction plates 73 and the position, in which the spring holder 77 fitting the bias springs 76 takes with respect to the shaft 48, so that the friction resistance can be easily adjusted to optimize the damping effect against the vibration. Moreover, the frictional resistance can be non-linearly changed by combining several kinds of friction plates 73 and 74 having different sizes such as several kinds of resin friction plates 73 having the different external diameters and several kinds of aluminum friction plates 74 having different internal diameters.

The azimuth electric motor 54 and the electric rotary coupling 59 are disposed below the damping mechanism 70 so that the devices belonging to the movable antenna 1 are minimized to reduce the weight of the movable side. If the movable side is lightened, the tracing mechanism for the target is simplified, regardless of whether it belongs to the passive, active or mixed platform type. With the movable side thus lightened, the weight to be borne by the horizontal damping mechanism 70 and the axial damping mechanism 71 is reduced to have a smaller size.

Figure 3:
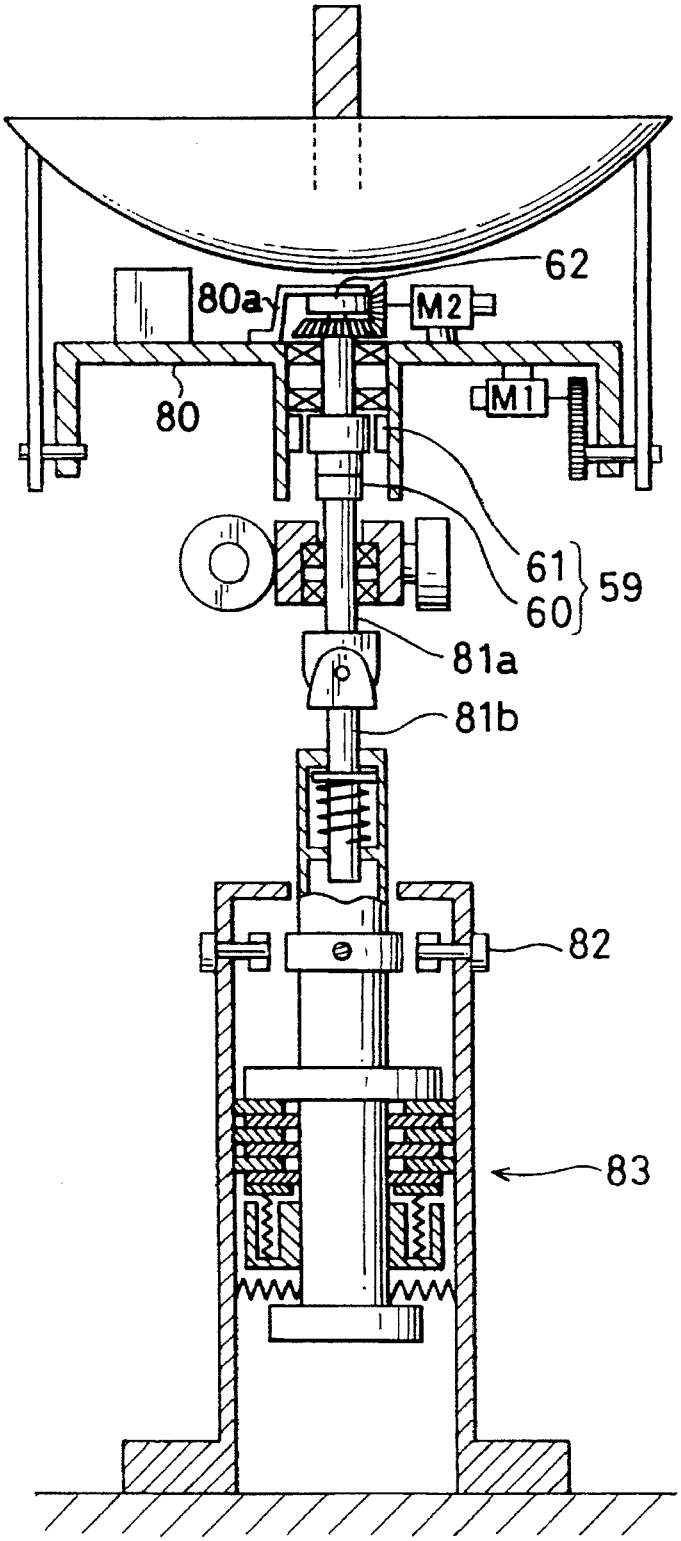
FIG. 3 is a section showing another an antenna orienting apparatus according to the present invention.

Referring to FIG. 3, a section shows another embodiment of the damping mechanism and electric rotary joint described above. As shown, the electric rotary joint is applied to the passive platform type of FIG. 4. Between a stable platform 80, corresponding to the platform 4, of FIG. 4 and a shaft 81*a* corresponding to the shaft 9*a* of FIG. 4, there is interposed the electric rotary joint 59 which is composed of the slip ring mechanism 60, the rotary transformer 61 and the rotary joint 62. The slip ring mechanism 60 and the rotary transformer 61 are disposed around the shaft 81*a*, and the rotary joint 62 is interposed between the upper end of the shaft 81*a* and a bracket 80*a* on the stable platform 80. Below a universal joint 82, corresponding to the spherical bearing 7 of FIG. 4, there is further disposed a horizontal damping mechanism 83. This damping mechanism 83 is identical to one which is inverted upside-down from the damping mechanism 70,71 of FIG. 1. Thus, the position of the damping mechanism or the electric rotary joint can be suitably changed. Moreover, if the vehicle does not change its direction so much but receives a high vibration, the damping mechanism can be exclusively applied. On the other hand, if the vehicle does not vibrate so much but changes its direction frequently, the electric rotary joint can also be exclusively applied.

Some satellite communications systems for small vessels, such as fishing boats, use analog modulations called the "INMARSAT A" and are equipped with antennas having diameters as large as about 90 cm. However, if the digital transmissions are used, the electric power necessary for the communications is reduced together with the sizes of antennas. Another satellite communications system according to the digital transmission is the "INMARSAT M" capable of using antennas having diameters as small as about 40 cm. With these small antennas, the movable portions of the antennas are lightened to improve the mobility drastically. It is then possible to provide an active platform type antenna orienting apparatus suited for the fishing boats. In this case, the horizontal damping mechanism using the aforementioned laminate is preferable because of its compactness and high efficiency.

Then, the electric rotary joint allowing the aforementioned unlimited rotation is also preferred.

We claim:

1. An apparatus for orienting an antenna on a vehicle, comprising:

a platform for supporting said antenna;

a base for mounting said apparatus to the vehicle;

said base including a fixed shaft;

a rotatable shaft defining a hollow interior;

said base further including bearing means for rotationally supporting said rotatable shaft;

shaft means for supporting said platform;

said rotatable shaft having a universal gimbals within said hollow interior for supporting said shaft means;

means for radially biasing and damping said shaft means within said hollow interior to axially align said shaft means with said rotatable shaft; and an electric rotary joint interposed between said rotatable shaft and said fixed shaft for transmitting power and signals necessary for communication transmission and antenna attitude control.

2. An apparatus for orienting an antenna on a vehicle, comprising:

a platform for supporting said antenna;

a post for supporting said platform;

a base carried on the vehicle;

a shaft defining a hollow interior;

said base including means for rotatably supporting said shaft;

said shaft having a universal gimbals within said hollow interior for supporting said post;

rotating means for rotating said post to set the azimuth angle of said antenna;

an electric rotary joint interposed between said base and said post for transmitting power and signals necessary for communication transmission and antenna attitude control; and means for radially biasing and damping said post within said hollow interior to axially align said post with said shaft.

3. An antenna orienting apparatus for a vehicle, comprising:

an antenna to be oriented at a target;

a platform supporting said antenna;

said platform including means for rotatably supporting said antenna such that an elevation angle of said antenna is variable;

a first electric motor mounted on said platform for setting the elevation angle of said antenna;

a receiver amplifier fixed on said platform for receiving a signal from said antenna;

a base carried on the vehicle;

a fixed shaft connected to said base;

a rotatable shaft fitted around said fixed shaft;

a second electric motor for rotating said rotatable shaft;

a first shaft supporting said platform;

a second shaft supported by said rotatable shaft;

a universal joint for connecting said first shaft and said second shaft;

receiver means, fixed on said base, for receiving a signal from said receiver amplifier;

an electrical rotary joint interposed between said receiver amplifier and said receiver means; and a slip ring mechanism interposed between said rotatable shaft and said fixed shaft for transmitting electric power to said first electric motor from a power supply on said base.

4. An antenna orienting apparatus for a vehicle, comprising: a base, fixed on the vehicle, including a hollow first shaft defining a tubular interior;

a second shaft;

a universal joint in the tubular interior of said first shaft coupling said first shaft to said second shaft;

bias means for biasing an axis of said second shaft toward an axis of said first shaft;

a laminate including first friction plates coupled to an inner circumference of said first shaft and second friction plates coupled to an outer circumference of said second shaft;

said first and second friction plates being interleaved and defining clearance margins with respect to the second and first shafts, respectively, to permit relative motion therebetween in directions substantially radial to said first and second shafts to damp vibrational motion in a spheroidal locus of motion defined by said universal joint;

facial bias means for applying a facial pressure to said laminate;

a third shaft slidably mounted in said second shaft to permit movement of said third shaft in an axial direction of said second shaft;

an axial damping mechanism engaging said third shaft and said second shaft;

a platform supported by said third shaft; and an antenna mounted on said platform.

5. An antenna orienting apparatus for a vehicle, comprising:

a base, fixed on the vehicle, including a hollow first shaft defining a tubular interior;

a second shaft;

a universal joint in the tubular interior of said first shaft coupling said first shaft to said second shaft;

bias means for biasing an axis of said second shaft toward an axis of said first shaft;

a laminate including first friction plates coupled to an inner circumference of said first shaft and second friction plates coupled to an outer circumference of said second shaft;

said first and second friction plates being interleaved and defining clearance margins with respect to the second and first shafts, respectively, to permit relative motion therebetween in directions substantially radial to said first and second shafts to damp vibrational motion in a spheroidal locus of motion defined by said universal joint;

facial bias means for applying a facial pressure to said laminate;

a third shaft slidably mounted in said second shaft to permit movement of said third shaft in an axial direction of said second shaft;

an axial damping mechanism engaging said third shaft and said second shaft;

a fourth shaft supporting a platform;

a universal joint connecting said third shaft and said fourth shaft; and an antenna mounted on said platform to be oriented toward a target.

6. An antenna orienting apparatus for a vehicle, as set forth in claim 5, wherein the first friction plates and the second friction plates of said laminate are a combination of sizes.

7. An antenna orienting apparatus for supporting an antenna on a vehicle, comprising:

a base, fixed on the vehicle, including a hollow first shaft defining a tubular interior;

a second shaft;

a universal joint in the tubular interior of said first shaft coupling said first shaft to said second shaft;

a third shaft slidably mounted in said second shaft to permit movement of said third shaft in an axial direction of said second shaft while supporting the antenna;

a damping mechanism, formed of a laminate of friction plates, interposed between said second shaft and said first shaft for damping vibrations in directions substantially perpendicular to an axis of said second shaft; and a damping mechanism interposed between said second shaft and said third shafts and for damping a vibration in the axial direction of said second shaft.

8. An antenna orienting apparatus for a vehicle, comprising:

a base fixed on a vehicle and having a vertical stationary shaft;

a hollow first shaft borne rotatably on said stationary shaft;

an electrical rotary joint interposed between said first shaft and said stationary shaft for transmitting power and signals necessary for transmitting communications and setting an attitude;

a second shaft;

a universal joint in the tubular interior of said first shaft coupling said first shaft to said second shaft;

bias means for biasing an axis of said second shaft toward an axis of said first shaft;

a laminate including first friction plates coupled to an inner circumference of said first shaft and second friction plates coupled to an outer circumference of said second shaft;

said first and second friction plates being interleaved and defining clearance margins with respect to the second and first shafts, respectively, to permit relative motion therebetween in directions substantially radial to said first and second shafts to damp vibrational motion in a spheroidal locus of motion defined by said universal joint;

facial bias means for applying a facial pressure to said laminate;

a third shaft slidably mounted in said second shaft to permit movement of said third shaft in an axial direction of said second shaft;

an axial damping mechanism engaging said third shaft and said second shaft;

a platform supported by said third shaft; and an antenna mounted on said platform.

9. An antenna orienting apparatus for a vehicle, comprising:

an antenna to be oriented at a target;

a platform supporting said antenna;

said platform including means for rotatably supporting said antenna such that an elevation angle of said antenna is variable;

a first electric motor mounted on said platform for setting the elevation angle of said antenna;

a receiver amplifier fixed on said platform for receiving a signal from said antenna;

a base, fixed on the vehicle, having a vertical stationary shaft;

a hollow first shaft borne rotatably on said stationary shaft;

receiver means, fixed on said base for receiving a signal from said receiver amplifier;

an electrical rotary joint interposed between said receiver amplifier and said receiver means; and a slip ring mechanism interposed between said first shaft and said stationary shaft for transmitting electric power to said first electric motor from a power supply on said base;

a second shaft;

a universal joint in the tubular interior of said first shaft coupling said first shaft to said second shaft;

bias means for biasing an axis of said second shaft toward an axis of said first shaft;

a laminate including first friction plates coupled to an inner circumference of said first shaft and second friction plates coupled to an outer circumference of said second shaft;

said first and second friction plates being interleaved and defining clearance margins with respect to the second and first shafts, respectively, to permit relative motion therebetween in directions substantially radial to said first and second shafts to damp vibrational motion in a spheroidal locus of motion defined by said universal joint;

facial bias means for applying a facial pressure to said laminate;

a third shaft slidably mounted in said second shaft to permit movement of said third shaft in an axial direction of said second shaft;

an axial damping mechanism engaging said third shaft and said second shaft;

a fourth shaft supporting said platform; and a universal joint connecting said third shaft and said fourth shaft.

10. An antenna orienting apparatus for a vehicle, comprising:

an antenna to be oriented at a target;

a platform supporting said antenna;

said platform including means for rotatably supporting said antenna such that an elevation angle of said antenna is variable;

a first electric motor mounted on said platform for setting the elevation angle of said antenna;

a receiver amplifier fixed on said platform for receiving a signal from said antenna;

a base, fixed on the vehicle, having a vertical stationary shaft;

a hollow first shaft borne rotatably on said stationary shaft;

a second electric motor for rotating said first shaft;

receiver means, fixed on said base, for receiving a signal from said receiver amplifier;

an electrical rotary joint interposed between said receiver amplifier and said receiver means;

a slip ring mechanism interposed between said first shaft and said stationary shaft for transmitting electric power to said first electric motor from a power supply on said base;

a second shaft;

a universal joint in the tubular interior of said first shaft coupling said first shaft to said second shaft;

bias means for biasing an axis of said second shaft toward an axis of said first shaft;

a laminate including first friction plates coupled to an inner circumference of said first shaft and second friction plates coupled to an outer circumference of said second shaft;

said first and second friction plates being interleaved and defining clearance margins with respect to the second and first shafts, respectively, to permit relative motion therebetween in directions substantially radial to said first and second shafts to damp vibrational motion in a spheroidal locus of motion defined by said universal joint;

facial bias means for applying a facial pressure to said laminate;

a third shaft slidably mounted in said second shaft to permit movement of said third shaft in an axial direction of said second shaft, said third shaft supposing said platform;

and an axial damping mechanism engaging said third shaft and said second shaft.

11. An antenna orienting apparatus for a vehicle, comprising:

an antenna to be oriented at a target;

a platform supporting said antenna;

said platform including means for rotatably supporting said antenna such that an elevation angle of said antenna is variable;

a receiver amplifier fixed on said platform for receiving a signal from said antenna;

a base, fixed on the vehicle, having a vertical stationary shaft;

a hollow first shaft borne rotatably on said stationary shaft;

an electric motor for rotating said first shaft;

receiver means, fixed on said base, for receiving a signal from said receiver amplifier;

an electrical rotary joint interposed between said receiver amplifier and said receiver means;

a second shaft;

a universal joint in the tubular interior of said first shaft coupling said first shaft to said second shaft;

a damping mechanism interposed between said second shaft and said first shaft for damping vibrations in directions substantially perpendicular to an axis of said second shaft;

a third shaft slidably mounted in said second shaft movable in an axial direction while supporting said platform; and an axial damping mechanism interposed between said third shaft and said second shaft for damping a vibration in the axial direction of said second shaft.

12. An apparatus for orienting an antenna on a vehicle, comprising:

a platform having means for rotatably supporting said antenna to permit adjustment of an elevation angle of said antenna;

a first electric motor mounted, on said platform, for setting the elevation angle of said antenna;

a receiver amplifier, fixed on said platform, for receiving a signal from said antenna;

a base carried on the vehicle;

said base having a fixed shaft connected thereto;

a rotatable shaft fitted around said fixed shaft;

means for rotatably supporting said rotatable shaft upon said fixed shaft;

said rotatable shaft supporting said platform;

a second electric motor for rotating said rotatable shaft;

receiver means, fixed on said base, for receiving a signal from said receiver amplifier;

an electrical rotary joint interposed between said receiver amplifier and said receiver means;

a slip ring mechanism interposed between said rotatable shaft and said fixed shaft for transmitting electric power to said first electric motor; and a rotary transformer interposed between said rotatable shaft and said fixed shaft for transmitting an electric control signal to said platform.

13. An apparatus for orienting an antenna on a vehicle, comprising:

a platform supporting said antenna;

said platform including means for rotatably supporting said antenna to allow variance of an elevation angle of said antenna;

a first electric motor, mounted on said platform, for setting the elevation angle of said antenna;

a receiver amplifier, fixed on said platform, for receiving a signal from said antenna;

a base carried on the vehicle;

said base having a fixed shaft connected thereto;

a hollow rotatable shaft defining a tubular interior fitted around said fixed shaft;

means for rotatably coupling said fixed shaft and said rotatable shaft;

a shaft for supporting said platform;

a universal joint in the tubular interior of said hollow rotatable shaft coupling said rotatable shaft to said supporting shaft;

said rotatable shaft supporting said platform;

a second electric motor for rotating said rotatable shaft;

receiver means, fixed on said base, for receiving a signal from said receiver amplifier;

an electrical rotary joint interposed between said receiver amplifier and said receiver means;

a slip ring mechanism, interposed between said rotatable shaft and said fixed shaft, for transmitting electric power to said first electric motor from said base; a rotary transformer, interposed between said rotatable shaft and said fixed shaft, for transmitting an electric control signal to said rotatably supporting means on said platform;

and a damping mechanism, interposed between said tubular interior of said hollow rotatable shaft and said supporting shaft, for damping vibrations from said vehicle.

14. An apparatus for orienting an antenna on a vehicle, comprising:

a base fixed on the vehicle and having a hollow first shaft defining a tubular interior;

a platform for supporting the antenna;

a second shaft for supporting the platform;

a universal joint in the tubular interior of said first shaft coupling said first shaft to said second shaft;

bias means for biasing an axis of said second shaft toward an axis of said first shaft;

a laminate including first friction plates coupled to an inner circumference of said first shaft and second friction plates coupled to an outer circumference of said second shaft;

said first and second friction plates being interleaved and defining clearance margins with respect to the second and first shafts, respectively, to permit relative motion therebetween in directions substantially radial to said first and second shafts to damp vibrational motion in a spheroidal locus of motion defined by said universal joint; and facial bias means for applying a facial pressure to said laminate.

15. The apparatus according to claim 14 further comprising:

a third shaft coupling said second shaft to said platform;

means for slidably mounting said third shaft slidably in said second shaft to permit movement of said third shaft in an axial direction of said second shaft; and an axial damping mechanism engaging said third shaft and said second shaft.

* * * * *